US005513475A

United States Patent [19]

Schaaf et al.

[11] Patent Number: 5,513,475

[45] Date of Patent: May 7, 1996

[54] MULTI-FACETED INTERFACIAL BUILDING BLOCKS

[76] Inventors: Cecil F. Schaaf, 3015 Palmer Rd., Standish, Mich. 48658; Craig R. Schaaf, 741 Crawford St., Flint, Mich. 48507

[21] Appl. No.: 245,452

[22] Filed: May 18, 1994

[51] Int. Cl.[6] ..... E04C 1/00

[52] U.S. Cl. ..... 52/606; 52/585.1; 52/586.1; 52/503; 52/604; 52/605

[58] Field of Search ..... 52/285.1, 503, 52/504, 505, 585.1, 586.1, 596, 604, 605, 606

[56] References Cited

U.S. PATENT DOCUMENTS

| | | | |
|---|---|---|---|
| 767,414 | 8/1904 | Kidder . | |
| 1,154,546 | 9/1915 | Peters . | |
| 1,234,990 | 7/1917 | Wilson . | |
| 1,683,441 | 9/1928 | Bone | 52/605 |
| 1,700,542 | 1/1929 | O'Donnell . | |
| 1,727,362 | 9/1929 | Bone | 52/605 |
| 1,792,663 | 2/1931 | Strack | 52/606 X |
| 1,816,916 | 8/1931 | Sentrop . | |
| 2,040,627 | 5/1936 | Dettler . | |
| 2,185,497 | 1/1940 | Cilento . | |
| 2,263,914 | 11/1941 | Bohn . | |
| 2,655,032 | 10/1953 | Zagray . | |
| 2,749,739 | 6/1956 | Zagray . | |
| 2,881,614 | 4/1959 | Preininger . | |
| 3,209,510 | 10/1965 | Nakanishi . | |
| 3,295,281 | 1/1967 | Dixon | 52/604 X |
| 3,534,518 | 10/1970 | Zagray . | |
| 3,609,926 | 10/1971 | Muse . | |
| 4,228,628 | 10/1980 | Schlomann | 52/604 X |
| 4,285,179 | 8/1981 | Goidinger . | |
| 4,295,313 | 10/1981 | Rassias . | |
| 4,355,549 | 6/1982 | Dean, Jr. . | |
| 4,425,748 | 1/1984 | De Walle . | |
| 4,532,747 | 8/1985 | Koetje | 52/586.1 |
| 4,590,729 | 5/1986 | Hegazi . | |
| 5,048,250 | 9/1991 | Elias . | |
| 5,291,711 | 3/1994 | Kopaz . | |

FOREIGN PATENT DOCUMENTS

| | | | |
|---|---|---|---|
| 2228687 | 1/1973 | Germany | 52/503 |
| 2452373 | 5/1976 | Germany | 52/605 |

*Primary Examiner*—Carl D. Friedman
*Assistant Examiner*—Kevin D. Wilkens
*Attorney, Agent, or Firm*—Robert L. McKellar

[57] ABSTRACT

Novel building blocks are used to build inexpensive, decorative walls and building, and the like. The blocks are multi-faceted such that all of the outside faces of the blocks will match each of the faces of other blocks and allow the construction of walls having unique decorative effects, while overcoming the problems associated with standard rectangular building blocks.

1 Claim, 2 Drawing Sheets

MULTI-FACETED INTERFACIAL BUILDING BLOCKS

This invention deals with novel building blocks and their use to build inexpensive, decorative walls and buildings, and the like.

More specifically, this invention deals with certain specific building blocks that when used in combination are useful to build decorative, strong, durable, decorative buildings and walls.

The blocks are multi-faceted such that all of the outside faces of the blocks will match each of the other faces of the block and allow the construction of walls having unique decorative effects, while overcoming the problems associated with standard rectangular building blocks of the prior art.

FIELD OF THE INVENTION

There are many various building blocks in use today, are manufactured primarily from cementitious materials. Many of these blocks have been developed with configurations having essentially the same outside surface, that is a rectangular block. When the rectangular building blocks are used to fabricate walls, the aesthetics of the wall leave much to be desired, in that essentially only a straight linear wall, with a vertical surface is created. Generally, only 90° corners can be used if a turn in the wall is required. Further, walls constructed with such blocks do not have the appropriate configurations to enable one to conveniently use iron rod and the like to stabilize the walls, and usually, these walls have to be laid on a concrete foundation in order to stand straight over a long period of time.

None of the building blocks in use today can be used to fabricate a strong, durable, decorative wall in which various angles can be built into the linear design. Further, walls can be built in serpentine configurations and various angled corners, in addition to 90° corners can be had, and, the blocks can be manufactured by conventional rectangular block manufacturing processes.

THE PRIOR ART

In the opinion of the inventors herein, the following patents all show rectangular block configurations and do not anticipate nor make obvious the blocks of the instant invention.

U.S. Pat. Nos. 767,414, issued Aug. 1, 1904 to Kidder; 1,154,546, issued to Peters on Sep. 21, 1915; 1,700,542, issued on Jan. 29, 1929 to O'Donnell; 1,234,990, issued Jul. 31, 1917 to Wilson; 1,816,916, issued Aug. 4, 1931 to Sentrop; 2,040,627, issued May 12, 1936; 2,185,497, issued Jan. 2, 1940 to Cilento et al.; 2,263,914, issued Nov. 25, 1941 to Bohn; 2,655,032, issued Oct 13, 1953 to Zagray; 2,749,739, issued Jun. 12, 1956 to Zagray; 2,881,614, issued Apr. 14, 1959 to Preininger; 3,209,510, issued Oct. 5, 1965 to Nakanishi; 3,534,518, issued Oct. 20, 1970 to Zagray; 3,609,926, issued Oct. 5, 1971 to Muse; 4,075,808, issued Feb. 28, 1978 to Pearlman; 4,285,179, issued Aug. 25, 1981 to Goidinger; 4,295,313, issued Oct. 20, 1981, to Rassias; 4,335,549, issued Jun. 22, 1982 to Dean; 4,425,748, issued Jan. 17, 1984 to De Waele; 4,590,729, issued May 27, 1986 to Hegazi; 5,048,250, issued Sep. 17, 1991 to Elias, and 5,291,711, issued Mar. 8, 1994 to Kopaz.

Thus, none of the art known to the inventors is believed to anticipate or make obvious the building blocks of the instant invention or their use to build walls.

THE INVENTION

The invention described herein deals with novel multi-faceted interfacial building blocks that are useful for constructing walls and the like.

Specifically, the invention described herein deals with a novel building block wherein said block has a short vertical axis and a horizontal linear axis and a flat upper surface, a flat bottom surface, two identical flat end surfaces and at least two side surfaces.

The block has a small, vertical, centered first opening through it and has a cavity adjacent one side of the small, vertical, centered first opening.

The side surfaces and flat end surfaces have a vertical, essentially centered, channel therein and each flat end surface has a semi-cavity in it adjacent the vertical channel therein and the block has two, large, second openings near each flat end, wherein each of the large second openings is situated essentially equidistant from each flat end.

BRIEF DESCRIPTION OF THE DRAWINGS

FIG. 2 is a full top view of a block which is another embodiment of this invention in which a long, linear, horizontal axis for the block is designated as A—A which is the longest axis of the block, and in which the short, vertical axis is designated by the point B. The vertical axis for purposes of discussion and clarification herein is shown at point B and should be considered to run perpendicular to the plane of the paper on which FIG. 2 is situated.

FIG. 4 is an full end view of the block of FIG. 3 showing the short, vertical axis B as being vertical on the surface of the paper on which the drawing is situated, while the long, linear, horizontal axis for the block is designated as point A, and only for purposes of discussion and clarification herein is shown to run perpendicular to the plane of the paper on which FIG. 4 is situated.

DETAILED DESCRIPTION OF THE INVENTION

This invention deals with novel multi-faceted interfacial building blocks that will allow the construction of a wall which is strong, durable, decorative and easy to build.

Figure 2:
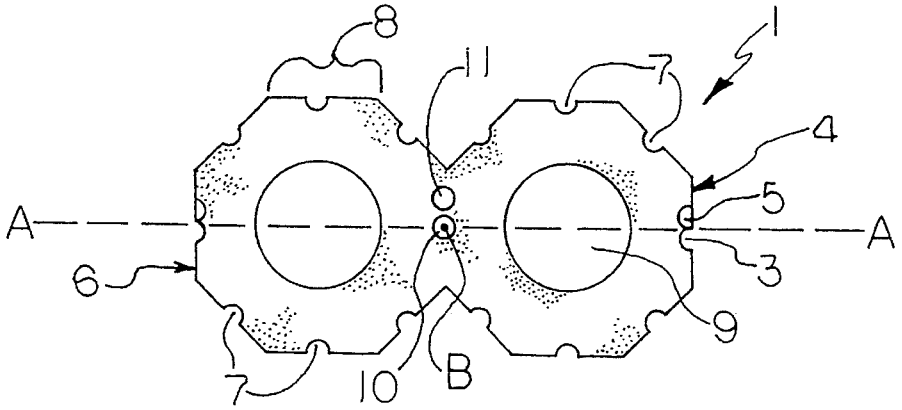
Figure 4:
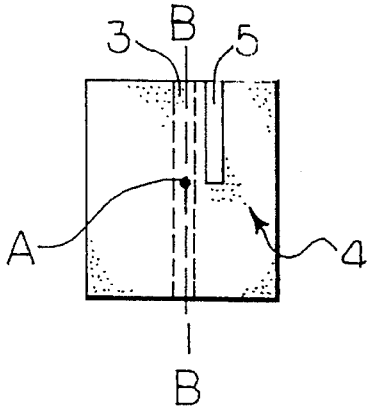

As can be observed from FIGS. 2 and 4, the blocks have a long axis as denoted by the line A—A, and a short axis denoted by the line B—B. For purposes of the description of the blocks herein, reference will be made with regard to the long axis and the short axis, without there being any intent on the part of the inventors herein to require that the blocks have any particular orientation to be within the scope of the claims herein.

Figure 1:
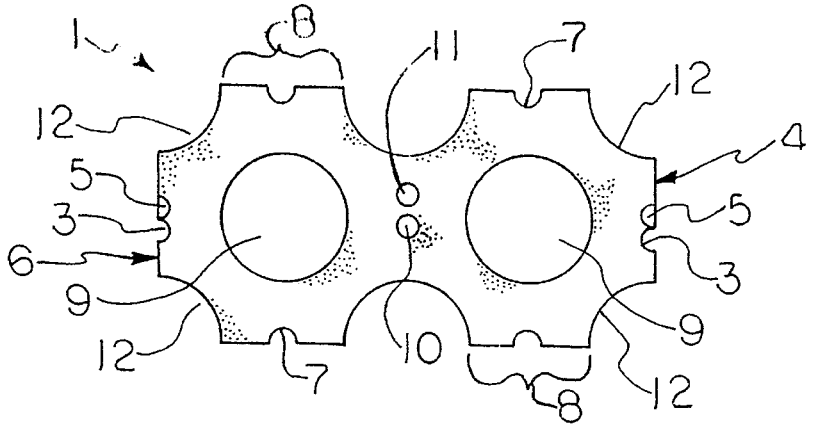
FIG. 1 is a full top view of a block which is one embodiment of this invention.

With reference to FIG. 1, there is shown a top view of a block 1 which is one embodiment of this invention, in which there is shown a top surface 2. The top surface 2 is intended to accommodate other blocks that are set thereon, and therefore, the surface has to be essentially smooth. Again, with reference to FIG. 1, there is shown a channel 3 in the end 4 of the block 1, and a semi-cavity 5. The channel 3 is intended to match with a similar channel 3 in the end 4 or 6 of another adjacent block to form a round hole capable of receiving steel rod. It should be noted that there is an identical channel 3 and semi-cavity 5 in the opposite end 6 of the block 1. It should be noted further that there is an identical channel 7 in each of the faceted side surfaces 8, shown in FIG. 1 as encompassed by the braces.

In addition, there is shown two, large vertical openings 9 (second openings) through the block 1, and it should be noted that these openings are situated such that they are essentially equidistant from the ends 4 and 6 of the block 1 in order that the blocks are uniform, and can be turned end to end and still match all of the channels and openings. The size of these second openings is such that they are able to cut down on the overall weight of the block 1, yet maintain enough concrete as a bridge between openings and channels, to maintain the required strength.

Finally, there is shown a small, vertical opening 10, centered in the middle of the block 1, which vertical opening is intended to receive steel rod. An adjacent cavity 11, which is not bored entirely through the block is also shown in FIG. 1. This cavity 11 is intended to receive pins (not shown), which lock the blocks together during and after construction.

Figure 3:
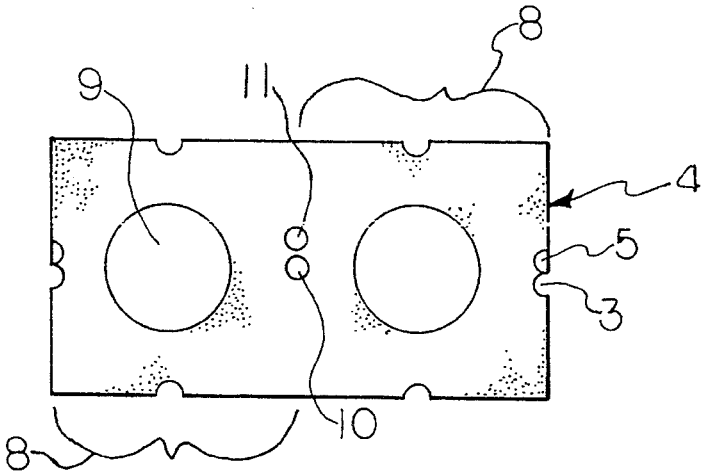
FIG. 3 is a full top view of a block which is yet another embodiment of this invention.

FIG. 3 is yet another embodiment of this invention in which the side surfaces 8 are essentially flat and in which there are only two such surfaces 8 for each side of the block. This particular configuration is the only block that cannot be configured to fit interfacially with the other blocks, in that its interfacial sides are too large.

FIG. 4 is an end view of the block of FIG. 3, and shows the channel 3, the cavity 5. Also shown is the vertical axis in line B—B, and the long, horizontal, linear axis shown as point A.

Figure 5:
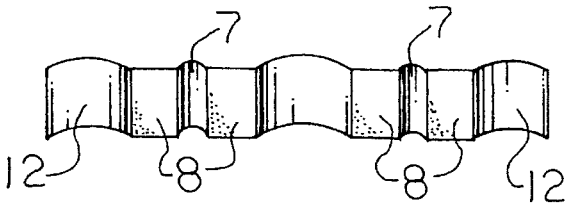
FIG. 5 is a partial, perspective view of the edge of the block of FIG. 1.

FIG. 5 is a side view of the block of FIG. 1, in which there is shown the side surface 8, and the channels 7. It will be remembered that the configuration of the block of FIG. 1 is such that there is a cleft 12 in each corner of the block 1.

Throughout this disclosure, the side surfaces have been described as side surface 8, and this side surface in each of the blocks is what allows for the many unique configurations that the blocks of this invention can have and from which the term "multi-faceted, interfacial" is derived for purposes of this invention.

It should be obvious to those skilled in the art, upon a reading of this specification and drawings that the blocks of this invention are unique and because of their multi-faceted configurations, can be used to create wall structures having many optional configurations.

Figure 6:
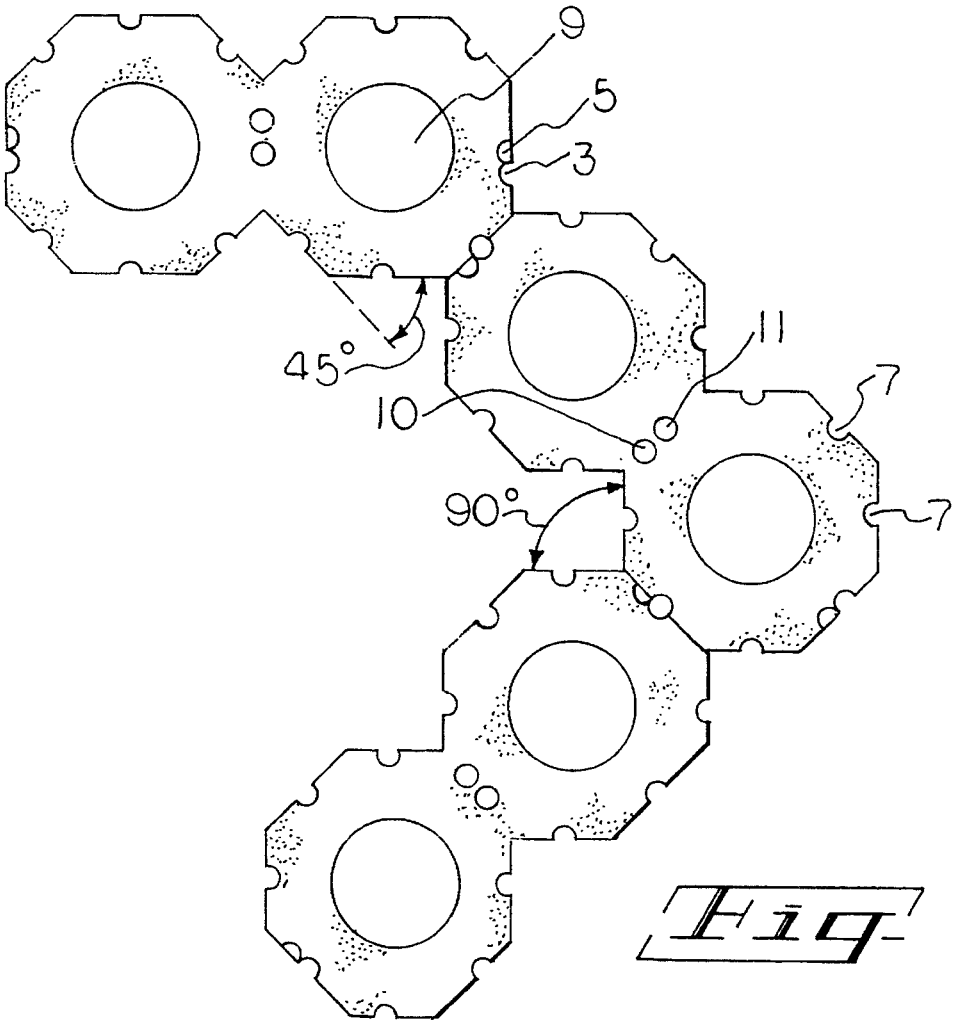
FIG. 6 is a top view of a portion of a wall fabricated from the block of FIG. 2 showing a portion of the various arrangements that can be had with the blocks of this invention.

For example, using the block configuration of FIG. 2, there is shown in FIG. 6, a first angle at 45° and another at 90° in a portion of a wall when viewed from the top.

Some of the various block configurations can be interchanged to give yet more options with regard to the angles that can be built into the wall, and the decorative effect that can be built into the wall.

The blocks of this invention have essentially symmetrical halves. When two of the blocks are adjacent to each other, such that the two cavities 5 are aligned, a full cavity 10 is formed, which then can receive a steel pin.

The overall dimensions of the blocks of this invention are essentially the same as the standard, commercial rectangular blocks however, the blocks of this invention can be manufactured to any reasonable thickness, on the order of 1 inch to 12 inches in thickness.

It should also be understood by those skilled in the art that these blocks can be used to construct buildings as well as walls, wherein they are mortared together rather than just being stacked on each other and bound by steel rod surrounded by cement.

We claim:

1. A multi-faceted building block, said block having a vertical axis and a horizontal axis, said horizontal axis being longer than said vertical axis;

said building block providing a flat upper surface, flat bottom surface, two identical flat end surfaces and at least four side surfaces;

said block having a small, vertical, centered first opening through it;

said block having a cavity adjacent one side of the small, vertical, centered first opening;

each said side surface and flat end surface having a vertical channel therein;

each said flat end surface having a semi-cavity therein, adjacent the vertical channel therein;

said block having therethrough, two large second openings near each flat end, each large second opening situated essentially equidistant from each flat end.

* * * * *